US005196660A

United States Patent [19]

Yoshimura et al.

[11] Patent Number: 5,196,660

[45] Date of Patent: Mar. 23, 1993

[54] ACCELERATION SENSOR

[75] Inventors: Kazuo Yoshimura; Shigeru Shimozono; Ryo Sato, all of Kanagawa, Japan

[73] Assignee: Takata Corporation, Tokyo, Japan

[21] Appl. No.: 793,154

[22] Filed: Nov. 18, 1991

[30] Foreign Application Priority Data

Dec. 25, 1990 [JP] Japan ..... 2-405802

[51] Int. Cl.[5] ..... H01H 35/14

[52] U.S. Cl. ..... 200/61.45 M; 200/61.53

[58] Field of Search ..... 200/61.45 R-61.53

[56] References Cited

U.S. PATENT DOCUMENTS 4,093,836 6/1978 Ewy et al. ..... 200/61.53
4,827,091 5/1989 Behr ..... 200/61.45 M
4,933,515 6/1990 Behr et al. ..... 200/61.45 M

*Primary Examiner*—J. R. Scott
*Attorney, Agent, or Firm*—Kanesaka and Takeuchi

[57] ABSTRACT

An accelerator sensor comprising a cylinder of a conductive material, a magnetized inertial member mounted in the cylinder so as to be movable longitudinally of the cylinder, a conductive member mounted at least on one end surface of the inertial member that faces a first longitudinal end of the cylinder, a pair of electrodes disposed at the first longitudinal end of the cylinder, and an atracting member disposed near the other longitudinal end of the cylinder. When the conductive member of the inertial member comes into contact with the electrodes, these electrodes are caused to conduct via the conductive member. The attracting member is made of a magnetic material such that the attracting member and the inertial member are magnetically attracted toward each other. The sensor further comprises a coil for testing the operation of the sensor and an another coil capable of biasing magnetically the inertial member to compensate operation of the cylinder due to temperature.

3 Claims, 1 Drawing Sheet

ACCELERATION SENSOR

FIELD OF THE INVENTION

The present invention relates to an acceleration sensor and, more particularly, to an acceleration sensor adapted to detect a large change in the speed of a vehicle caused by a collision or the like.

BACKGROUND OF THE INVENTION

An acceleration sensor of this kind is described in U.S. Pat. No. 4,827,091. This known sensor comprises a cylinder made of a conductive material, a magnetized inertial member mounted in the cylinder so as to be movable longitudinally of the cylinder, a conductive member mounted at least on one end surface of the inertial member which is on a side of one longitudinal end of the cylinder, a pair of electrodes disposed at the one longitudinal end of the cylinder, an attracting member disposed near the other longitudinal end of the cylinder and a testing coil for testing operation of the inertial member. When the conductive member of the magnetized inertial member makes contact with the electrodes, these electrodes are caused to conduct via the conductive member. The attracting member is made of such a magnetic material that the attracting member and the inertial member are magnetically attracted towards each other.

In this acceleration sensor, the magnetized inertial member attracts and the attracting member. When no or almost no acceleration is applied to the sensor, the inertial member is at rest at the other end in the cylinder.

If a relatively large acceleration acts on this acceleration sensor, the magnetized inertial member moves against the attracting force of the attracting member. During the movement of the inertial member,. an electrical current is induced in this cylinder, to produce a magnetic force which biases the inertial member in the direction opposite to the direction of movement of the inertial member. Therefore, the magnetized inertial member is braked, so that speed of the movement is reduced.

When the acceleration is less than a predetermined magnitude, or threshold value, the magnetized inertial member comes to a stop before it reaches the front end of the cylinder. Then, the inertial member is pulled back by the attracting force of the attracting member.

When the acceleration is greater than the predetermined magnitude, or the threshold value, e.g., the vehicle carrying this acceleration sensor collides with an object, the inertial member arrives at the one end of the cylinder. At this time, the conductive layer on the front end surface of the inertial member makes contact with both electrodes to electrically connect them with each other. If a voltage has been previously applied between the electrodes, an electrical current flows when a short circuit occurs between them. This electrical current detects collision of the vehicle.

When the testing coil is energized, the inertial member is moved up to the front end of the cylinder to make contact with the electrodes. Therefore, the testing coil is used for testing operation of the member.

It was found by the inventors that if the temperature of the surroundings of the acceleration sensor using the cylinder made of oxygen-free copper rises, then the electric resistance of the cylinder increases considerably. This reduces the electrical current induced by the movement of the magnetized inertial member. As a result, the magnetic braking force applied to the inertial member becomes less than intended.

Conversely, if the ambient temperature drops, the electric resistance of the cylinder decreases considerably. The result is that the magnetic braking force produced by the electrical current induced by the movement of the inertial member becomes greater than intended.

Where the braking force or damping force applied to the magnetized inertial member varies greatly, the acceleration sensor detects accelerations with great errors.

SUMMARY OF THE INVENTION

It is an object of the present invention to provide an acceleration sensor for detecting a change of a vehicle speed at a collision which is capable of preventing variation of the braking or damping force applied to the inertial member when the temperature of the surroundings of the acceleration sensor rises or drops.

The novel acceleration sensor comprises: a cylinder made of a conductive material; a magnetized inertial member mounted in the cylinder so as to be movable longitudinally of the cylinder; a conductive member mounted on one end surface of the inertial member which faces one longitudinal end of the cylinder; a pair of electrodes which are disposed at this one longitudinal end of the cylinder and which, when the conductive member of the inertial member makes contact with the electrodes, are caused to conduct via the conductive member; an attracting member disposed near the other longitudinal end of the cylinder and made of a magnetic material which magnetically attracts the inertial member, a testing coil to test operation of the inertial member wound around the cylinder and a further coil which is capable of biasing magnetically the inertial member.

Hereafter, the testing coil is called occasionally "the first coil", and the other coil is called "the second coil".

In this novel acceleration sensor, the inertial member is capable of being biased magnetically by the energized second coil in both directions in part as the force applied by the attracting member and the force opposite thereto. Therefore, the braking or damping force applied to the inertial member is compensated when the temperature of the surroundings of the sensor goes up or down.

In addition, since the second coil is induced according to a speed of the inertial member when it moves, the speed is detected by measuring inductive electromotive force induced in the second coil.

DETAILED DESCRIPTION OF THE INVENTION

Figure 1:
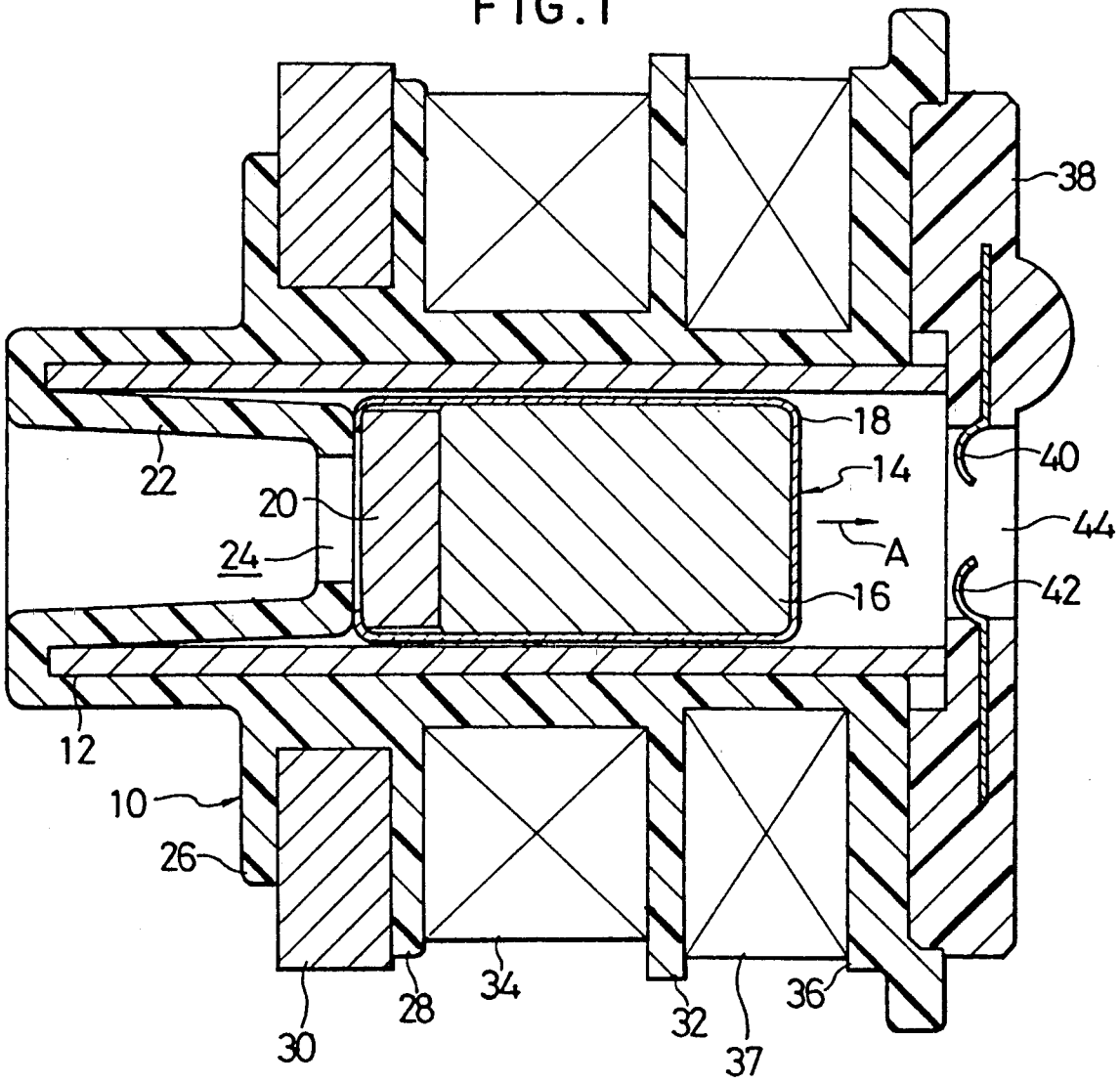
FIG. 1 is a cross-sectional view of an acceleration sensor according to the invention.

Referring to the FIG. 1, there is shown an acceleration sensor according to the invention. This sensor has a cylindrical bobbin 10 made of a nonmagnetic material such as a synthetic resin. A cylinder 12 made of a copper alloy is held inside the bobbin 10. A magnetized inertial member or magnet assembly 14 is mounted in the cylinder 12. This assembly 14 comprises a core 16 made of a cylindrical permanent magnet, a cylindrical case 18 having a bottom at one end, and a packing 20 made of a synthetic resin. The case 18 is made of a nonmagnetic conductive material such as copper and encloses the core 16. The case 16. The case 18 is opened at the other end thereof. The packing 20 acts to hold the core 16 within the case 18. The magnet assembly 14 is fitted in the cylinder 12 in such a way that it can move longitudinally of the cylinder 12.

The bobbin 10 has an insert portion 22 at its one end This insert portion 22 extends into the cylinder 12. An opening 24 is formed at the front end of the insert portion 22. A pair of flanges 26 and 28 protrudes laterally near the front end of the insert portion 22 of the bobbin 10. An annular attracting member or return washer 30 which is made of a magnetic material such as iron is held between the flanges 26 and 28.

The bobbin 10 has another flange 32. A first coil 34 is wound between the flanges 28 and 32. A further flange 36 is formed at the other end of the bobbin 10. A second coil 37 is wound between the flanges 36 and 32.

A contact holder 38 is mounted to this flange 36. This contact holder 38 is made of a synthetic resin. A pair of electrodes 40 and 42 are buried in the holder 38. An opening 44 is formed in the center of the holder 38. The front ends of the electrodes 40 and 42 protrude into the opening 44. The electrodes 40 and 42 have arc-shaped front end portions: Parts of the arc-shaped front end portions are substantially flush with the front end surface of the cylinder 12.

Lead wires (not shown) are connected with the rear ends of the electrodes 40 and 42 to permit application of a voltage between them.

The operation of the acceleration sensor constructed as described thus far is now described. When no external force is applied, the magnet assembly 14 and the return washer 30 attract to each other. Under this condition, the rear end of the magnet assembly 14 is in its rearmost position where it bears against the front end surface of the insert portion 22. If an external force acts in the direction indicated by the arrow A, then the magnet assembly 14 moves in the direction indicated by the arrow A against the attracting force of the return washer 30. This movement induces an electrical current in the cylinder 12 made of a copper alloy, thus producing a magnetic field. This magnetic field applies a magnetic force to the magnet assembly 14 in the direction opposite to the direction of movement. As a result, the assembly 14 is braked.

Where the external force applied to the acceleration sensor is small, the magnet assembly 14 comes to a stop on its way to one end of the cylinder 12. The magnet assembly 14 will soon be returned to its rearmost position shown in FIG. 1 by the attracting force acting between the return washer 30 and the magnet assembly 14.

If a large external force is applied in the direction indicated by the arrow A when the vehicle collides, then the magnet assembly 14 is advanced up to the front end of the cylinder 12 and comes into contact with the electrodes 40 and 42. At this time, the case 18 of the magnet assembly 14 which is made of a conductive material creates a short-circuit between the electrodes 40 and 42, thus producing an electrical current between them. This detects an acceleration change greater than the intended threshold value. Consequently, the collision of the vehicle is detected.

The first coil 34 is used to check the operation of the acceleration sensor. In particular, when the coil 34 is electrically energized, it produces a magnetic field which biases the magnet assembly 14 in the direction indicated by the arrow A. The magnet assembly 14 then advances up, to the front end of the cylinder 12, and short-circuits the electrodes 40 and 42. In this way, the coil 34 is energized to urge the magnet assembly 14 to move. Thus, it is possible to make a check to see if the magnet assembly 14 can move back and forth without trouble and if the electrodes 40 and 42 can be short-circuited.

The second coil 37 is used to compensate for a change of the braking force applied to the magnet assembly 14 caused by increase or decrease of electric resistance of the cylinder when the surrounding temperature rises or drops. Namely, when the temperature rises, the resistance becomes larger so that induced current of the second coil by a movement of the magnet assembly 14 and the braking force applied thereto becomes less. In such a situation, the second coil 37 is energized to compensate for the decrease of the braking force whereby the magnet assembly 14 is braked with a standard braking force.

Conversely, when the ambient temperature drops, the electric resistance of the cylinder 12 decreases. Therefore, in this situation, the second coil is energized so as to reduce the magnetic braking force applied to the magnet assembly 14 by the conductive current of the cylinder.

In this way, the braking force applied to the magnet assembly 14 is compensated by the second coil 37.

Furthermore, a conductive current is induced in the second coil 37 when the magnet assembly 14 moves, and an induced electromotive force of the coil 37 becomes larger with increase of a speed of the magnet assembly 14. Therefore, the speed is detected by measuring the induced electromotive force. In addition, operation of the sensor is checked by detecting the speed.

The following operation is also available with using the second coil.

The first coil is backed up by the second coil when an anomaly occurs.

The abnormality of the first coil is detected.

As described above, the acceleration sensor of the present invention comprises the cylinder made of a conductive material, a movable inertial member located within the cylinder, a first coil for testing the operation of the sensor and a second coil for preventing variation of the braking or damping force applied to the inertial member due to changes in ambient temperature. According to the sensor, the acceleration is detected precisely even if the temperature of the surroundings of the sensor varies.

Accordingly, the operation of the sensor is checked by detecting a moving speed of the inertial member.

What is claimed is:

1. An acceleration sensor comprising:

a cylinder made of a conductive material and having first and second ends located at longitudinal ends thereof;

a magnetized inertial member situated in the cylinder so as to be slidable longitudinally of the cylinder;

a conductive member mounted on at least one end surface of the inertial member, said end surface facing the first end of the cylinder, a pair of electrodes disposed at the first end of the cylinder, said electrodes being electrically connected together when the conductive member mounted on the inertial member contacts the electrodes, an attracting member disposed near the second end of the cylinder, said attracting member being made of a magnetic material and attracting the inertial member to be located near the second end of the cylinder, a first coil wound around the cylinder, said first coil, when actuated, operating to move the inertial member toward the first end to electrically connect the electrodes together by contacting the conductive member on the inertial member to the electrodes, a second coil wound around the cylinder near the first end to compensate movement of the inertial member when acceleration is applied to the inertial member, said second coil being actuated in a condition such that a braking force which is created and applied to the inertial member when the inertial member is moved inside the cylinder upon detection of a predetermined acceleration is outside a predetermined range, and said second coil forming a magnetic field around the cylinder to move the inertial member inside the cylinder within the predetermined range, and means for actuating the second coil to compensate a variation of resistance of the cylinder so that the braking force applied to the inertial member is within the predetermined range.

2. The acceleration sensor of claim 1 wherein said second coil is actuated to increase the braking force applied to the inertial member when the braking force is not sufficiently applied to the inertial member due to increase of the temperature surrounding the sensor above a predetermined value.

3. The acceleration sensor of claim 1, wherein said second coil is actuated to decrease the braking force applied to the inertial member when the braking force is excessively applied to the inertial member due to decrease of the temperature surrounding the sensor below a predetermined value.

* * * * *